US005210471A

United States Patent [19]

Nuckolls et al.

[11] Patent Number: 5,210,471

[45] Date of Patent: May 11, 1993

[54] CONTROLLED-CURRENT LAMP STARTING CIRUIT

[75] Inventors: Joe A. Nuckolls; Isaac L. Flory, IV, both of Blacksburg, Va.

[73] Assignee: Hubbell Incorporated, Orange, Conn.

[21] Appl. No.: 778,660

[22] Filed: Oct. 18, 1991

[51] Int. Cl.[5] ..... H05B 37/00

[52] U.S. Cl. ..... 315/289; 315/283

[58] Field of Search ..... 315/289, 290, 276, 283, 315/207, DIG. 5, 205

[56] References Cited

U.S. PATENT DOCUMENTS

| | | | |
|---|---|---|---|
| 2,326,597 | 8/1943 | Abernathy | 315/99 |
| 2,575,001 | 11/1951 | Bird | 315/276 |
| 3,249,859 | 5/1966 | Speros et al. | 324/24 |
| 3,328,673 | 1/1966 | Nuckolls | 323/21 |
| 3,334,270 | 8/1967 | Nuckolls | 315/171 |
| 3,407,334 | 10/1968 | Attewell | 315/278 |
| 3,496,412 | 2/1970 | Taylor et al. | 315/244 |
| 3,522,475 | 8/1970 | Hashimoto | 315/239 |
| 3,917,976 | 11/1975 | Nuckolls | 315/258 |
| 3,944,876 | 3/1976 | Helmuth | 315/205 |
| 4,072,878 | 2/1978 | Engel | 315/289 |
| 4,184,103 | 1/1980 | Stein | 315/276 |
| 4,342,948 | 8/1982 | Samuels | 315/290 |
| 4,415,837 | 11/1983 | Sodini | 315/289 |
| 4,441,056 | 4/1984 | Siglock | 315/290 |

*Primary Examiner*—Eugene R. LaRoche
*Assistant Examiner*—A. Zarabian
*Attorney, Agent, or Firm*—Jerry M. Presson; Walter C. Farley

[57] ABSTRACT

A starting circuit for a discharge lamp includes a tapped ballast transformer connected at one end to an AC supply and at the other end to a discharge lamp. A capacitor and charging resistor are connected in series across the lamp. A breakdown switch device and a current-limiting resistor are connected in series with each other between the transformer tap and the junction between the capacitor and charging resistor. When the capacitor charges to the breakdown value, it discharges through the breakdown device, current-limiting resistor and transformer, producing an output pulse to start the lamp. The value of the current-limiting resistor is selected to limit and shape the peak of the output pulse.

7 Claims, 3 Drawing Sheets

CONTROLLED-CURRENT LAMP STARTING CIRUIT

FIELD OF THE INVENTION

This invention relates to a starting circuit for a discharge lamp with controlled-current starting characteristics.

BACKGROUND OF THE INVENTION

Discharge lamps, including high intensity discharge lamps such as high pressure sodium and the like, generally require high voltage pulses to initiate the ignition process within the lamp. High voltage pulses are applied to the lamp for starting and then, after the arc within the lamp is established, the supply voltage is lowered to an operating level, the actual level depending upon the characteristics of the particular lamp.

Among the circuits used for lamp starting are those which employ a tapped transformer, a discharge device, and a capacitor with a charging circuit, the capacitor being charged to a level at which it discharges through part of the transformer, creating the starting pulse or pulses.

Generally speaking, the magnitude of the starting pulse is established by selecting the parameters of the transformer and the characteristics and values of other components such as the discharge device and the capacitor. However, once these characteristics and values have been chosen, the circuit output in the starting mode is essentially uncontrolled.

It has been found that certain lamps, notably metal halide arc tubes, respond better to pulses having greater width. It appears that the scandium-iodide system with those lamps responds well to a pulse of lower magnitude but greater width. In addition, it is desirable to reduce the starting pulse to the lowest acceptable level in order to reduce the dielectric stress on both the lamp and ballast. Metal halide arc tubes are not placed in an evacuated environment in the way that other lamps, such as high pressure sodium. As a result, the possibility of breakdown within the lamp is much greater with metal halide. Reducing dielectric stress reduces the liklihood of lamp failure.

As a practical matter, alteration of the transformer ratio is an expensive matter and adds greatly to the cost of a system unless the transformer is going to be used for a large number of devices. Alteration of the values of the other circuit components has limited effect on the circuit output.

Furthermore, changing the turns ratio of the transformer is not a satisfactory solution. Changing the ratio to give the desired pulse width results in dropping the pulse magnitude. To compensate for this lower magnitude, the turns ratio would again need to be modified by adding more turns to the secondary which would decrease performance and also increase ballast size and cost.

SUMMARY OF THE INVENTION

Accordingly, an object of the present invention is to provide a starting circuit for controlled-current starting of a discharge lamp.

A further object is to provide a circuit in which the magnitude and width of the pulse produced for lamp starting is controllable by the addition and selection of the value of a resistive component in the circuit.

Briefly described, the invention comprises a starting circuit for controlled-current starting of a discharge lamp, the circuit having a transformer with a winding having first, second and third terminals. An AC source is connected to the first terminal and a common terminal, the second terminal and the common being connectable to a discharge lamp. A charging resistor-capacitor circuit is connected to the second terminal and a second circuit including a discharge device and a current limiting resistor is connected between the third terminal of the transformer and the capacitor of the first circuit. In operation, the capacitor charges through the charging resistor until the capacitor voltage causes the discharge device to become conductive, allowing the capacitor to discharge through the second circuit and a portion of the transformer, producing a pulse which appears across the lamp, the current limiting resistor having a value selected to control the characteristics of the output pulse.

The magnitude and the width of the output pulse are controllable in this fashion.

BRIEF DESCRIPTION OF THE DRAWINGS

In order to impart full understanding of the manner in which these and other objects are attained in accordance with the invention, a particularly advantageous embodiment thereof will be described with reference to the accompanying drawings, which form a part of this disclosure, and wherein.

DESCRIPTION OF THE PREFERRED EMBODIMENT

Figure 1:
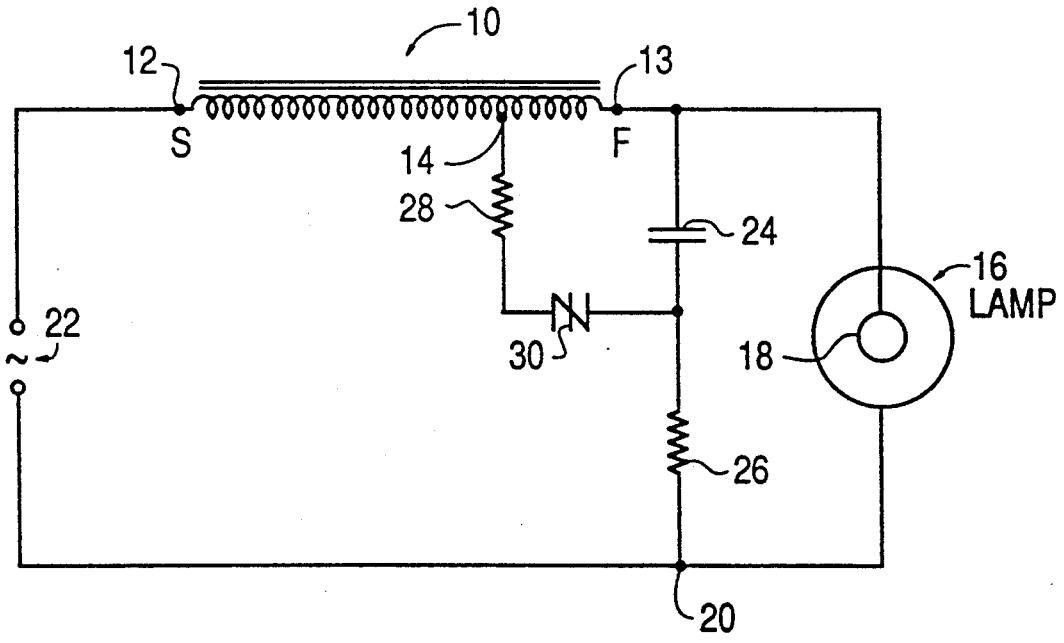
FIG. 1 is a schematic diagram of a circuit in accordance with the invention.

Referring first to FIG. 1, a ballast transformer indicated generally at 10 includes a winding having first and second end terminals 12 and 13 and a third terminal 14 which is a tap intermediate the end terminals and closer to the finish end of the winding at terminal 13. Transformer 10 is a coil and core transformer of a type designed for use with a high intensity discharge lamp such as the Electro-Reg ballast transformer manufactured and sold by the Lighting Division of Hubbell Incorporated, Christiansburg, Va. A lamp socket 16 for receiving a discharge lamp has a center terminal 18 connected to end terminal 13 of the transformer winding and a shell connected to a common terminal 20. An AC source indicated generally at 22 is connected to terminal 12 and to common terminal 20.

A first series circuit includes a capacitor 24 and a fixed charging resistor 26, this series circuit being connected between terminal 13 and common terminal 20, in parallel with the lamp. A second series circuit including a resistor 28 and a semiconductor discharge device 30 is connected between tap 14 and the junction between capacitor 24 and resistor 26.

In operation, capacitor 24 charges through resistor 26 driven by the open-circuit voltage of the ballast before the lamp ignites. When the voltage on capacitor C1 reaches the voltage breakover level of the bi-directional switch 30, the energy stored in capacitor 24 is allowed to discharge through the series circuit including the portion of the transformer winding between tap 14 and finish terminal 13, resistor 28 and switch 30. The energy passing through the end portion of the ballast winding is magnetically coupled to the remainder of the transformer, in an auto-transformer fashion, thereby producing a considerably larger voltage spike which appears across the lamp terminals. As will be recognized, one factor which determines the characteristics of the output pulse which appears across the lamp is the ratio of the windings between terminals 14 and 13 to the number of turns between terminals 14 and 12. Typically, this ratio is in the order of 1:20.

However, in the circuit shown in FIG. 1, the value of resistor 28 limits the level of discharge current from capacitor 24 through the winding and thereby has a direct effect upon the nature and shape of the output pulse. It has heretofore been customary to design such a circuit in a way that minimizes resistance in the circuit which delivers energy to the transformer, taking care to include no fixed resistors and to minimize the impedance of the remainder of the circuit. It has been found, however, that certain lamp types and chemistries are more compatible with certain shapes and sizes of ignition pulses. Some lamps do not ignite as well with a narrow starting pulse whereas other lamps respond better to narrow pulses which occur with greater frequency. Including a resistor 28 tends to produce a wider pulse which is particularly helpful in starting metal halide lamps under both hot and cold starting conditions. Typically, the circuit component values are as follows:

| | |
|---|---|
| Capacitor 24 | 0.47 μFD, 400 V. |
| Resistor 26 | 5 kOhm. 25 watt |
| Resistor 28 | 1 Ohm. 5 watt |
| Switch 30 | Bilateral trigger thyristor, 240 V. |

Figure 2:
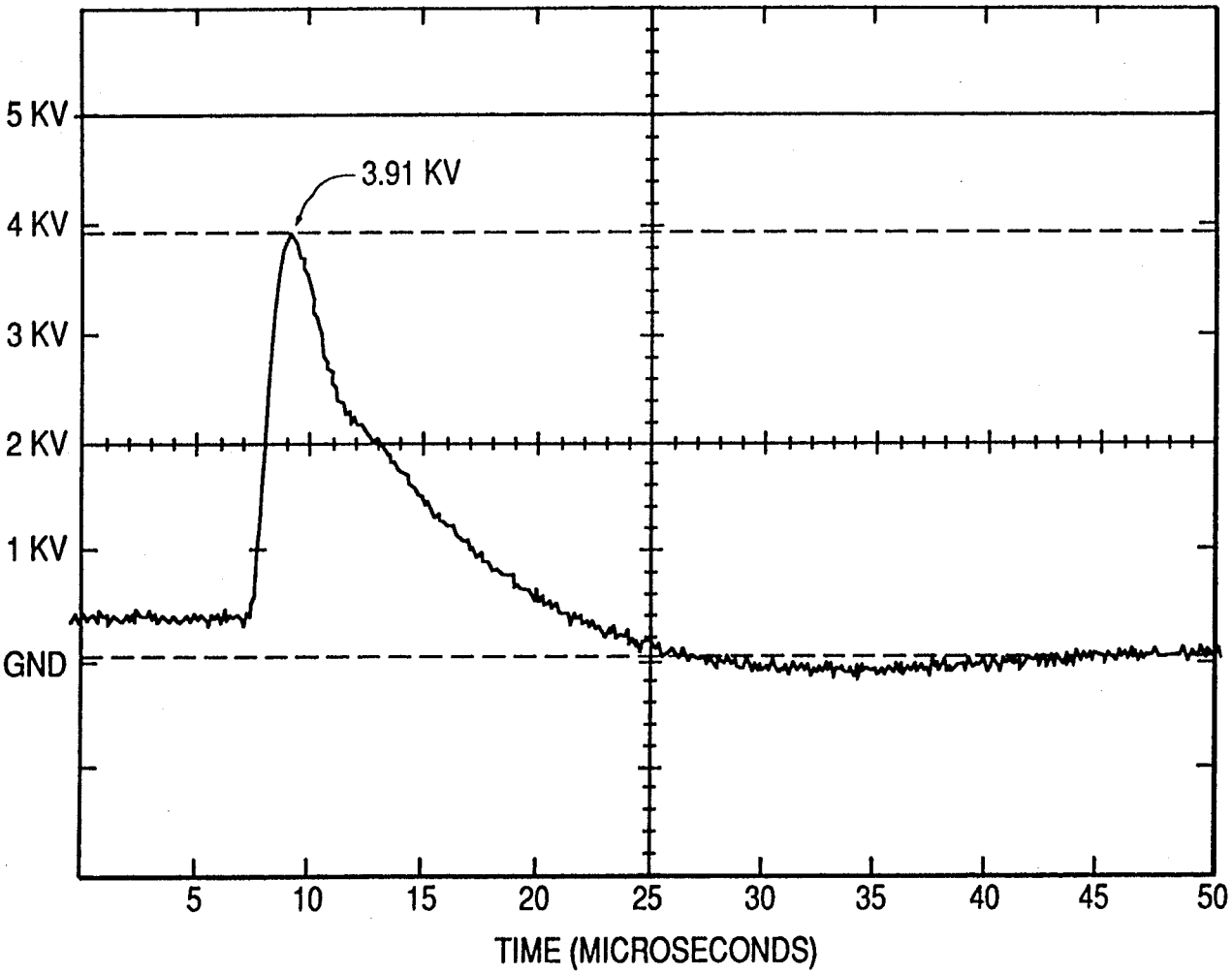
FIGS. 2 and 3 are graphical representations of the characteristics of the output pulse produced with and without the current limiting resistance in the circuit of FIG. 1.
Figure 3:
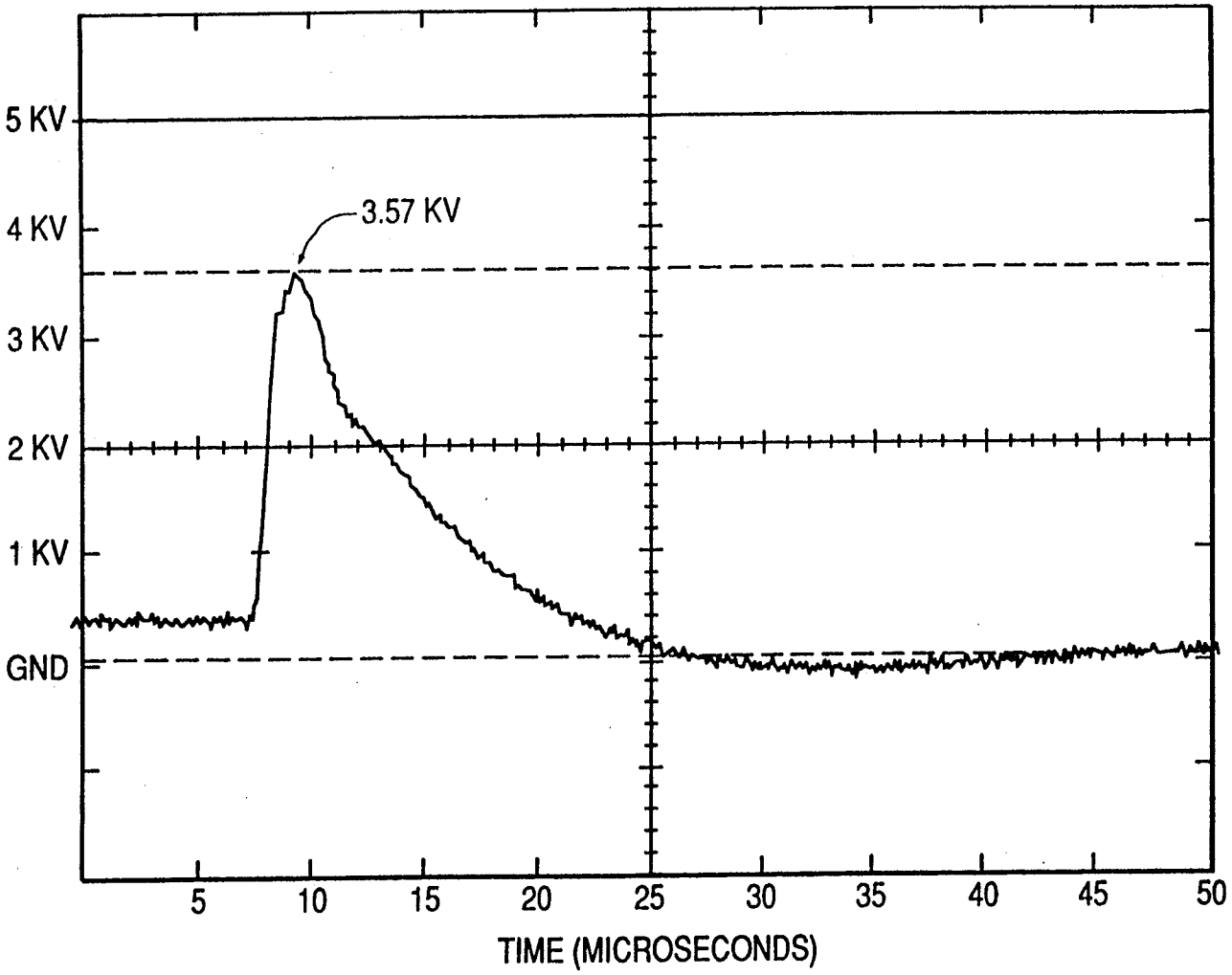

FIG. 2 shows an igniter pulse which is produced by a circuit similar to FIG. 1 but with a resistor 28 value of zero. In this particular circuit, the peak voltage of the pulse produced is approximately 3.91 kv. FIG. 3 shows a pulse produced by the circuit of FIG. 1 with a resistor 28 having a value of x ohms. It will be observed that the peak value of the pulse in FIG. 3 is about 3.57 kv and that the width of the pulse, particularly in the region adjacent the peak, is wider than that in FIG. 2, a characteristic which significantly improves the starting characteristic of the metal halide lamps.

While one advantageous embodiment has been chosen to illustrate the invention, it will be understood by those skilled in the art that various changes and modifications can be made therein without departing from the scope of the invention as defined in the appended claims.

What is claimed is:

1. A starting circuit for controlled-current starting of a discharge lamp comprising the combination of a transformer having a winding with first, second and third terminals;

an AC source connected to said first terminal and a common terminal, said second terminal and said common terminal being connectable to a discharge lamp;

a first circuit including a capacitor and a charging resistor connected to said second terminal;

a second series circuit including a discharge device having a breakover voltage and a current limiting resistor connected in a discharge path between said third terminal of said transformer and said capacitor of said first circuit;

whereby said capacitor charges through said charging resistor from said AC supply until said capacitor voltage exceeds said breakover voltage, causing said capacitor to discharge through said second series circuit and a portion of said transformer with substantially all discharge current from said capacitor passing through said current limiting resistor and generate an output pulse applied to said lamp, said current limiting resistor having a value selected to control shape characteristics of said pulse.

2. A starting circuit for controlled-current starting of a discharge lamp comprising the combination of a ballast transformer having a winding with a tap and first and second end terminals;

an AC source connected to one of said end terminals and a common terminal, said second end terminal and said common terminal being connectable to a discharge lamp;

a first circuit including a capacitor and a first resistor connected to said second end terminal and said common terminal with a junction between said capacitor and said first resistor;

a second series circuit including a discharge device having a breakover voltage and a current limiting resistor connected in a discharge path between said tap and said junction, whereby said capacitor charges through said first resistor during one half-cycle of said AC supply until said capacitor voltage exceeds said breakover voltage, causing said capacitor to discharge through said second series circuit and a portion of said transformer between said tap and said second terminal with substantially all discharge current from said capacitor passing through said current limiting resistor and generating an output pulse applied to said lamp, said current limiting resistor having a value selected to control shape characteristics of said pulse.

3. A circuit according to claim 2 wherein said second terminal is the finish end of said transformer winding.

4. A circuit according to claim 3 wherein said characteristics of said pulse include magnitude and width.

5. A circuit according to claim 3 wherein said ballast transformer is a coil and core high intensity discharge lamp ballast.

6. A circuit according to claim 5 wherein said lamp is a metal halide lamp.

7. A circuit according to claim 2 wherein said lamp is a metal halide lamp.

* * * * *